US009016205B2

(12) United States Patent
Lübbers et al.

(10) Patent No.: US 9,016,205 B2
(45) Date of Patent: Apr. 28, 2015

(54) VARIABLE CAPACITY IRRITATION BODY

(75) Inventors: Thorsten Lübbers, Lütjensee (DE); Kai Lübbers, Trittau (DE); Frank Habel, Hohnstorf (DE)

(73) Assignee: Rheinmetall Waffe Munition GmbH, Unterlüss (DE)

( * ) Notice: Subject to any disclaimer, the term of this patent is extended or adjusted under 35 U.S.C. 154(b) by 209 days.

(21) Appl. No.: 13/304,501

(22) Filed: Nov. 25, 2011

(65) Prior Publication Data

US 2012/0132100 A1 May 31, 2012

Related U.S. Application Data

(60) Provisional application No. 61/470,082, filed on Mar. 31, 2011.

(30) Foreign Application Priority Data

Nov. 24, 2010 (DE) ..... 10 2010 052 210

(51) Int. Cl.

| | |
|---|---|
| ***F42B 8/26*** | (2006.01) |
| ***F42B 27/00*** | (2006.01) |
| ***F42B 12/46*** | (2006.01) |
| ***F42B 12/36*** | (2006.01) |
| ***F42B 12/42*** | (2006.01) |

(52) U.S. Cl.

CPC . *F42B 12/36* (2013.01); *F42B 8/26* (2013.01); *F42B 12/46* (2013.01); *F42B 12/42* (2013.01); *F42B 27/00* (2013.01)

(58) Field of Classification Search

USPC ..... 102/473, 482, 487, 489, 334, 367, 368, 102/502, 513, 529, 498, 364, 369, 370

See application file for complete search history.

(56) References Cited

U.S. PATENT DOCUMENTS 4,932,328 A * 6/1990 Pinkney et al. ..... 102/482
5,654,523 A * 8/1997 Brunn ..... 102/498

(Continued)

FOREIGN PATENT DOCUMENTS

DE 92 10 649.4 U1 11/1992
DE 92 13 375.4 U1 12/1992

(Continued)

OTHER PUBLICATIONS

International Preliminary Report on Patentability; PCT/EP2011/005422; May 2013.*

(Continued)

*Primary Examiner* — James Bergin
(74) *Attorney, Agent, or Firm* — Griffin & Szipl, P.C.

(57) ABSTRACT

An irritation body (100, 100') is proposed, which is formed by at least two modules (101, 102). The upper module (101) serves for acceptance of an ignition head (1) with tilt lever (3) and comprises upper blow-out apertures (8, 9). The lower module (102) is intended for acceptance of an effect-charge (11) with the effect-charge (11) being integrated in a central chamber (10) of a module (102). The chamber (10) itself is functionally connected with the upper blow-out apertures (8, 9) and also with the lower blow-out apertures (12, 18, 19, 20) in the lower module (102). The chamber (10) in the lower module (102) can, depending upon module (102), be selected in different sizes, which produces, under concomitant volume variability, output variability with defined increase in output.

18 Claims, 1 Drawing Sheet

(56) References Cited

U.S. PATENT DOCUMENTS

| | | | | |
|---|---|---|---|---|
| 6,595,139 | B1 | 7/2003 | Haeselich | |
| 6,871,594 | B1 | 3/2005 | Estrella | |
| 7,721,651 | B2 | 5/2010 | Lubbers et al. | |
| 8,091,480 | B2 * | 1/2012 | Lubbers | 102/368 |
| 8,136,437 | B2 * | 3/2012 | Van Stratum et al. | 86/1.1 |
| 8,161,883 | B1 * | 4/2012 | Harasts et al. | 102/482 |
| 2008/0276822 | A1 | 11/2008 | Lubbers et al. | |
| 2010/0199874 | A1 | 8/2010 | Lubbers et al. | |
| 2013/0104766 | A1 * | 5/2013 | Thomas | 102/487 |

FOREIGN PATENT DOCUMENTS

| | | | |
|---|---|---|---|
| DE | 92 13 376.2 | | 1/1993 |
| DE | 199 44 486 | A1 | 4/2001 |
| DE | 10 2004 059 991 | A1 | 6/2006 |
| DE | 10 2008 058 776 | A1 | 5/2010 |
| WO | 94/08200 | | 4/1994 |
| WO | WO 2012/069119 | A1 * | 5/2012 |
| WO | WO 2012/069120 | A1 * | 5/2012 |

OTHER PUBLICATIONS

English translation of DE 92 10 649 U1; translated by the United States Patent and Trademark Office in Aug. 2013.*

English Translation of the International Search Report for PCT/EP2011/005422; May 2012.* http://www.bildwoerterbuch.com/en/society/weapons/hand-grenade.php, downloaded Nov. 25, 2011, 2 pages.

International Search Report issued in related application PCT/EP2011/005422, completed Jan. 24, 2012 and mailed Feb. 1, 2012.

Office Action issued in related German application 10 2010 052 210.4 on Mar. 14, 2013.

* cited by examiner

VARIABLE CAPACITY IRRITATION BODY

This application claims priority from U.S. Provisional Patent Application No. 61/470,082, filed Mar. 31, 2011, and from DE 10 2010 052 210.4, filed Nov. 24, 2010, the entire disclosures of which are incorporated herein by reference.

FIELD OF THE INVENTION

The invention is concerned with the possibility of output and, therewith, related volume variation of the effect-charge of an irritant body, which can be realized in that the irritant body is of modular design. The one module preferably comprises all needed components for unlocking and igniting the effect-charge, and another module comprises a central chamber for acceptance of the effect-charge, specifically, a loud bang or sound producing explosive charge. This second module can have different chambers with respect to geometry and/or volume, as a result of which the possibility exists, depending upon selection of chamber size, i.e., the corresponding module, of output adjustment and/or optimization of an irritant body. The capability of the irritant body is thus variable; moreover, the output effectiveness itself is directly adjustable.

BACKGROUND OF THE INVENTION

Irritant bodies of this type primarily serve for non-lethal defensive or protective action and are employed, among others, in a supporting role in the case of police or military interventions. They are similar to hand grenades, which are usually ignited manually and then tossed away, but which should not form any fragments themselves. In other words, an irritant body is a device that may contain an explosive charge, however, the explosive charge does not cause fragmentation of the irritant body, which distinguishes an irritant body from a hand grenade because hand grenades fragment due to their explosive charge.

DE 199 44 486 C2 describes an irritant body for manual ignition and hurling into the air with several sections extending essentially parallel to the center axis of the container, which accept the effect-charges, which are ignited, in turn, in time-staggered fashion.

DE 92 13 376 U1 discloses an irritant body identified as a shock weapon, having several sections that can accept the loud bang or flash charges. The irritant body itself has an ignition device with a common ignition channel, with tap drill holes distributed over its entire length, leading to the respective section.

An irritant body with a tilt lever is known from DE 10 2004 059 991 B1, which is formed by a body with integrated delayed action components and effect-charge(s). The delayed action components, or the delayed action path, are arranged in a separate small tube, which is imported into the basic irritant body with an ignition head with lever. The cross sections of the blow-out apertures at the upper end of the basic body of the irritant body are kept smaller than the cross sections of the blow-out apertures at the lower end, as a result of which the blow-out apertures of the two sides are designed as recoil-neutral. The explosive charge itself is arranged in chambers, so-called "flash chambers." This generally involves 6 chambers, which can accept approximately 8-10 g of a flash set or effective set. These chambers are distributed symmetrically arranged around the center axis and each is connected with the delayed ignition path. Filling of chambers with the effective set generally takes place through the blow-out apertures from above. At the upper as well as at the lower end, the chambers are sealed by sealing elements. These sealing elements, designed as cardboard discs, are ejected from the individual chambers after/upon ignition of the effect-charge or the effective set and form, in turn, fragments, which, however, is unwelcome in regard to the aforementioned irritant bodies. The effects that are produced by the effective set, for example, the sound (loud noise), leave the irritant body through the thus achieved blow-out apertures (i.e., upper and lower blow-out apertures).

Due to the limitation of construction space of the containers, it is difficult to realize in practice any desired increase in output. In this context, relative to such requirement, the DE 10 2008 058 776 A1 proposes to incorporate in the free area at the bottom of the irritant body an additional body with an additional effect-charge. Even though this method appears to be effective in increasing output, it is the object of the invention to create an irritant body that more conveniently satisfies the requirement for an increase in output.

SUMMARY OF THE INVENTION

Means for attaining the object of the invention are provided by the characteristics of a first embodiment, which pertains to a variable-output irritant body (100, 100') provided with an ignition head (1) and a tilting lever (3) comprising at least one upper and one lower blow-out aperture (8, 9, 12, 18, 19), an ignition (6) with delayed action setting and an effect-charge (11) characterized in that the irritant body (100, 100') comprises at least two modules (101, 102) wherein the one, first module (101) is for receiving the ignition head (1) with the tilting lever (3), and the other, second module (102) is for receiving the effect-charge (11); and the modules (101, 102) can be separated from each other but also connected with each other. Beneficial additional embodiments of the invention are reflected in the summary that follows.

For example, in accordance with a second embodiment of the present invention, the first embodiment is modified so that the effect-charge (11) in a preferably central chamber (10) of the other module (102) is functionally linked to the blow-out apertures (8, 9, 12, 18, 19, 20) and the chamber (10). In accordance with a third embodiment of the present invention, the second embodiment is further modified so that different modules (102) can be combined with the first module (101) so that these second modules (102) can have differently sized chambers (10). In accordance with a fourth embodiment of the present invention, the first embodiment, the second embodiment, and the third embodiment, are further modified so that integration as an eccentric hole is performed with only one aperture (8, 12).

In accordance with a fifth embodiment of the present invention, the first embodiment, the second embodiment, the third embodiment, and the fourth embodiment, are further modified so that the chamber (10) is centrally and preferably symmetrically arranged around the center axis M of the irritant body (100, 100'). In accordance with a sixth embodiment of the present invention, the first embodiment, the second embodiment, the third embodiment, the fourth embodiment, and the fifth embodiment, are further modified so that the one or the several lower drill holes or blow-out apertures (12, 18, 19, 20) are placed in the lower region of chamber (10) eccentrically and preferably distributed irregularly around the center axis (M). In accordance with a seventh embodiment of the present invention, the first embodiment, the second embodiment, the third embodiment, the fourth embodiment, the fifth embodiment, and the sixth embodiment, are further modified so that the blow-out apertures (8, 9, 12, 18, 19, 20) are integrated extending obliquely relative to chamber (10).

More generally, the invention is based on the idea of conceiving an irritant body, whose output adjustment or output increase is realized by offering or including different chambers and, connected therewith, different volumes for acceptance of effect-charge(s). Consequently, it is the intention to preferably execute the irritant body in modular form. To that end, the irritant body comprises at least two connectable modules, which together form the variable irritant body. Both modules on their own are connectable with every other module of the irritant body. The one module contains the delayed action set with delayed action path as well as the blow-out aperture(s) and accepts, in known fashion, the ignition head provided with ignition cap and ignition housing. The other module contains a common chamber for acceptance of explosive or effect-charge. At the lower bottom of the chamber are the lower blow-out apertures. This second module can be designed in such manner that each comprises differently sized chambers. The modularity of the two body parts into one variable irritant body makes it possible to attach an adapted lower body with different chamber volumes and/or blow-out arrangements at the upper body of the irritant body.

The common or central chamber can be filled with the effective set by means of at least one, preferably however several, upper blow-out apertures. It is understood that the individual chamber can be sub-divided in at least two partial chambers by one or several vertical walls, if that is desired, with ignition of the effective set then likewise is able to occur from above and, thus, also is guaranteed in the partial chambers. The intersections between the chamber and the blow-out apertures (upper and lower) are closed by a sealing element. The fixed connection between the two body parts can be established by means of crimping, flanging or welding, etc., or also by means of easily detachable connections, such as screw attachment, latch mechanism etc.

In addition to the already mentioned benefit, technical production benefits can also be realized in accordance with the present invention. Placement of rivets with a basic body within the irritant bodies can be waived. Needed only is an O-ring (between the upper and the lower part) which, in addition, is incorporated as an axial sealing device. A bushing is no longer needed as well due to the structure of the present invention. As a result of the larger filling apertures, which are no longer dependent upon the diameter of the individual chambers to be filled, easier filling is achieved. A larger amount of the effect-charge can be accepted via the central chamber. The chamber in the lower module can be selected in a different size, depending on the module, so that therewith concomitant volume variability causes output variability with prescribed output increase, or is also directly adjustable.

The increase of utilizable volume (by up to 100%) is particularly of great benefit with the use of sets containing no perchlorate, in accordance with the present invention.

In sum then, the present invention pertains to a variable capacity irritation body (100, 100'), which is formed by at least two modules (101, 102). The upper module (101) serves for acceptance of an ignition head (1) with tilt lever (3) and comprises upper blow-out apertures (8, 9). The lower module (102) is intended for acceptance of an effect-charge (11) with the effect-charge (11) integrated in a central chamber (10) of another module (102). The chamber (10) itself is functionally connected with the upper blow-out apertures (8, 9) and also with the lower blow-out apertures (12, 18, 19, 20) in the lower module (102). The chamber (10) in the lower module (102) can, depending upon the configuration of the module (102), be selected in different sizes, which produces, under concomitant volume variability, output variability with selectively defined increase in output.

BRIEF DESCRIPTION OF THE DRAWINGS

The invention will be explained in more detail based on an exemplary embodiment with Drawing(s).

DETAILED DESCRIPTION OF THE INVENTION

Figure 1:
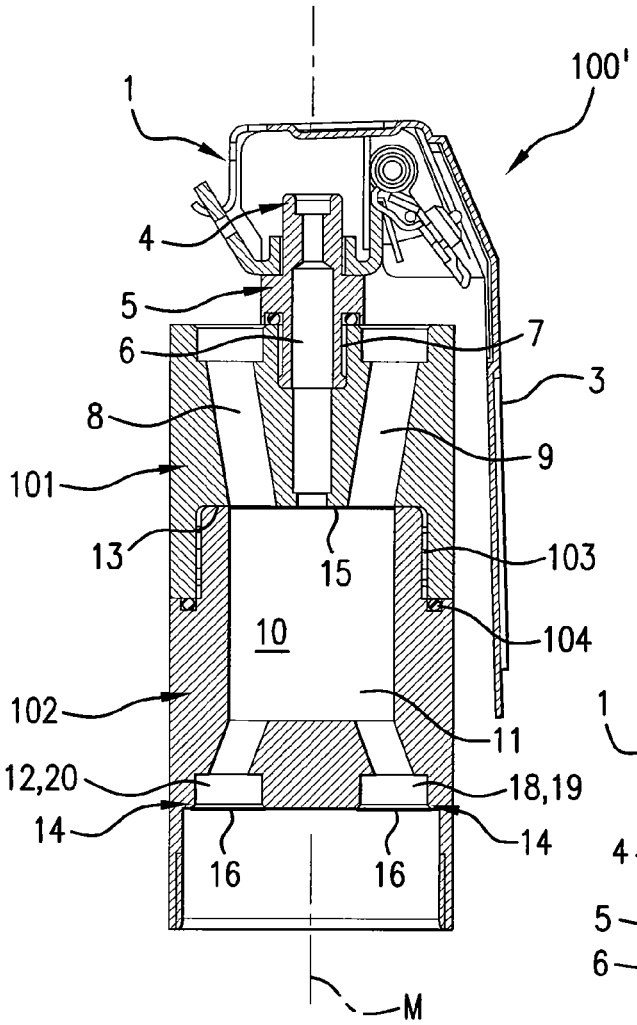
FIG. 1 illustrates a first illustrative embodiment of a two-part irritant body in accordance with the present invention.
Figure 2:
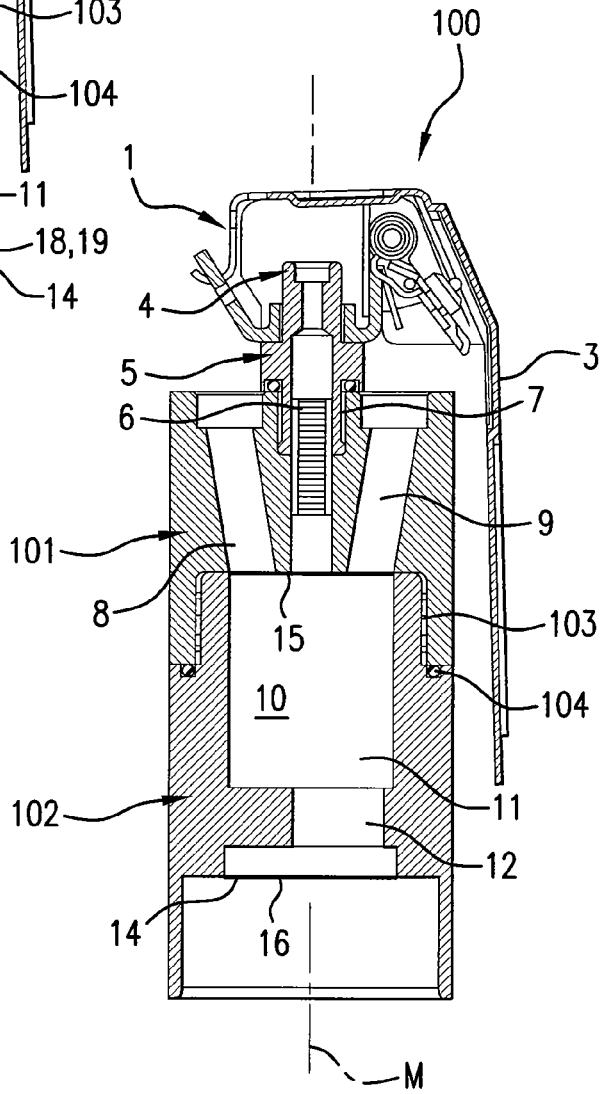
FIG. 2 illustrates another illustrative embodiment of a two-part irritant body in accordance with the present invention.

FIG. 1 and FIG. 2 depict an irritant body 100, 100', comprising a two-part module-type basic body 101, 102. Both modules 101, 102 are, for example, connectable with each other by means of a latch connection 103. Other fixed connections, detachable as well as non-detachable, can also be employed. Between both modules 101, 102 is provided an axially introduced O-ring 104 as a sealing ring.

The upper (first) module 101 serves for acceptance of an ignition head 1. The ignition head comprises, in addition to a tilting lever 3, an ignition cap 4 and an ignition housing 5 for acceptance of an ignition charge 6 with delayed action set. The ignition head 1 is, for example, screwed in the module housing of module 101, to which end has an ignition head acceptance 7 ("ignition charge recess"), which serves to contain an igniter of the ignition charge 6 of the irritant body. Around the ignition head acceptance 7 are incorporated at least one, preferably several—for example six—blow-out apertures 8, 9. These apertures 8, 9 issue in a central chamber 10 of the exchangeable second module 102, which serves for acceptance of an effect-charge or an effective set 11. The chamber 10 is centrally, and preferably symmetrically, incorporated around the center axis M of the irritant body 100 in the second module 102. The ignition charge 6 and the chamber 10 are aligned or adjusted to each other in such manner that they preferably act from above and centrally upon the effect-charge/effect-load 11 of chamber 10 and can ignite the effect-charge/effect-load 11. In the lower region of chamber 10 is provided at least one aperture 12 (FIG. 2), which serves, like the upper apertures 8 (9), for expelling the ignited effective set 11. The irritant body 100' can have, in the lower region of chamber 10, a single aperture, but also several, preferably four to six, apertures 18, 19, 20, may be employed.

The lower (second) module 102 distinguishes itself, according to the invention, in that it can have, with identical basic design and structure, different interior chamber sizes and chamber geometries. For example, a module 102 may be constructed that has a chamber having a lower volume or a lower quantity capacity. Thus, in accordance with the present invention, lower modules 102 provided with different chamber sizes and chamber geometries are provided that may be readily attached to, or exchanged with, an upper module 101. Due to the modular character of the two modules 101, 102, various lower modules 102 can readily be attached to, or exchanged with, the upper module 101. Depending upon what output is required from the irritant body, a module 102 provided with the appropriate chamber size is connected with the upper module 101 that most closely satisfies the requirement of the user of the irritant body (e.g., non-lethal defensive action or protective action). An irritant body 100, 100' can thus be assembled that can accept an effect-charge 11 ranging from 2-15 g of flash set, for example, 12 g of a flash set, and which merits the functional safety in this spectrum of effect-charge capacity. If the known exterior dimensions of the irritant body 100, 100' and/or lower module 102 are changed as well, chamber 10 can also be adjusted to the new dimensions, and the output of the irritant body 100, 100' can further be increased.

The intersections 13, 14—between chamber 10 and the upper apertures 8, (9), 12, or the lower apertures 12, 18, 19, 20 vis-à-vis the environment—can be closed by closing elements 15, 16. The closing elements 15, 16 can be light cardboard discs. In case of integration of only one (also larger) aperture 8, 12, it should be done as an eccentric bore hole in order to thus be able to influence the flight characteristics of the irritant body.

In order to achieve the result that the impulses cancel each other out with exit of the ignited effect-charge from these apertures, the cross-sections of the upper apertures 8 (9) and those of the lower apertures 12, 18, 19 should be matched with each other. In order to reduce the possibility of fragment formation, it is, moreover, provided that the one or several lower bore holes or apertures 12, 18, 19 are arranged off-center in the lower region of chamber 10 and, preferably, irregularly around the center axis M, as a result of which an asymmetry is created that additionally produces a preferred turbulence of the ignited effect-charge 11. This preferred turbulence of the ignited effect-charge 11 reduces the formation of fragments.

The invention claimed is:

1. A variable capacity irritation body provided with an ignition head and a tilting lever attached to the ignition head, wherein the irritation body further comprises:

(a) an igniter provided with a delayed action setting, wherein the ignition is connected to the ignition head;

(b) an effect-charge;

(c) at least two modules including a first module and a second module, wherein the first module receives the ignition head with the tilting lever attached to the ignition head, and the second module receives the effect-charge, wherein the first module and the second module are separable from each other but are also connectable with each other;

(d) at least one upper blow-out aperture formed in the first module; and (e) at least one lower blow-out aperture formed in the second module, and a chamber formed in the second module, wherein when the first module is connected to the second module the at least one upper blow-out aperture and the at least one lower blow-out aperture are in passageway communication with the chamber formed in the second module, and the effect-charge is disposed in the chamber of the second module, there being no chamber in the first module.

2. A variable capacity irritation body according to claim 1, wherein the chamber is a central chamber of the second module, and the effect-charge is functionally linked to the at least one upper blow-out aperture, and to the at least one lower blow-out aperture, and to the central chamber.

3. A variable capacity irritation body according to claim 2, wherein a plurality of different second modules are connectable with the first module, wherein the size of the chamber of each second module is the same or is different from the other second modules.

4. A variable capacity irritation body according to claim 3, wherein the at least one upper aperture and the at least one lower aperture are integrated as only one aperture that forms an eccentric hole through the irritation body.

5. A variable capacity irritation body according to claim 4, wherein the central chamber is centrally and symmetrically arranged around a center axis of the irritation body.

6. A variable capacity irritation body according to claim 3, wherein the central chamber is centrally and symmetrically arranged around a center axis of the irritation body.

7. A variable capacity irritation body according to claim 2, wherein the at least one upper aperture and the at least one lower aperture are integrated as only one aperture that forms an eccentric hole through the irritation body.

8. A variable capacity irritation body according to claim 7, wherein the central chamber is centrally and symmetrically arranged around a center axis of the irritation body.

9. A variable capacity irritation body according to claim 2, wherein the central chamber is centrally and symmetrically arranged around a center axis of the irritation body.

10. A variable capacity irritation body according to claim 1, wherein the at least one upper aperture and the at least one lower aperture are integrated as only one aperture that forms an eccentric hole through the irritation body.

11. A variable capacity irritation body according to claim 10, wherein the chamber is centrally and symmetrically arranged around a center axis of the irritation body.

12. A variable capacity irritation body according to claim 1, wherein the chamber is centrally and symmetrically arranged around a center axis of the irritation body.

13. A variable capacity irritation body according to claim 1, wherein one to several lower drill holes are placed in a lower region of the chamber so that the one to several lower drill holes are eccentrically and irregularly distributed around a center axis of the irritation body.

14. A variable capacity irritation body according to claim 1, wherein the passageways extend obliquely relative to the chamber.

15. A variable capacity irritation body according to claim 1, wherein each intersection between the chamber and the at least one upper blow-out aperture, and each intersection between the chamber and the at least one lower blow-out aperture, is closed by a closing element.

16. A variable capacity irritation body according to claim 15, wherein the closing element is a cardboard disc.

17. A variable capacity irritation body provided with an ignition head and a tilting lever attached to the ignition head, wherein the irritation body further comprises:

(a) an igniter provided with a delayed action setting, wherein the ignition is connected to the ignition head;

(b) an effect-charge;

(c) at least two modules including a first module and a second module, wherein the first module receives the ignition head with the tilting lever attached to the ignition head, and the second module receives the effect-charge, wherein the first module and the second module are separable from each other but are also connectable with each other;

(d) at least one upper blow-out aperture formed in the first module; and (e) at least one lower blow-out aperture formed in the second module, and a chamber formed in the second module, wherein when the first module is connected to the second module the at least one upper blow-out aperture and the at least one lower blow-out aperture are in passageway communication with the chamber formed in the second module, and the effect charge is disposed in the chamber of the second module, wherein there is no chamber in the first module, wherein the chamber is a central chamber of the second module, and the effect-charge is functionally linked to the at least one upper blow-out aperture, and to the at least one lower blow-out aperture, and to the central chamber, and wherein one to several lower drill holes or one to several blow-out apertures are placed in a lower region of the chamber so that the one to several lower drill holes or the one to several blow-out apertures, respectively, are eccentrically and irregularly distributed around a center axis of the irritation body, and wherein each intersection between the chamber and the at least one upper blow-out aperture, and each intersection between the chamber and the at least one lower blow-out aperture, is closed by a closing element.

18. A variable capacity irritation body according to claim 1, wherein one to several blow-out apertures are placed in a lower region of the chamber so that the one to several blow-out apertures are eccentrically and irregularly distributed around a center axis of the irritation body.

* * * * *